US008167459B2

(12) United States Patent
Wang

(10) Patent No.: US 8,167,459 B2
(45) Date of Patent: May 1, 2012

(54) LED LIGHTING FIXTURE

(75) Inventor: Sean Xiaolu Wang, Wilmington, DE (US)

(73) Assignee: BWT Property, Inc., Newark, DE (US)

( * ) Notice: Subject to any disclaimer, the term of this patent is extended or adjusted under 35 U.S.C. 154(b) by 294 days.

(21) Appl. No.: 12/478,096

(22) Filed: Jun. 4, 2009

(65) Prior Publication Data

US 2009/0322229 A1 Dec. 31, 2009

Related U.S. Application Data

(60) Provisional application No. 61/075,597, filed on Jun. 25, 2008.

(51) Int. Cl.
*F21V 29/00* (2006.01)
*E01F 9/016* (2006.01)

(52) U.S. Cl. ..... 362/294; 362/153.1; 362/373

(58) Field of Classification Search ..... 362/294, 362/373, 470, 267, 153.1, 805, 249.02; 165/45, 165/80.2, 80.4, 104.21, 104.33
See application file for complete search history.

(56) References Cited

U.S. PATENT DOCUMENTS

| | | | | |
|---|---|---|---|---|
| 5,806,966 | A * | 9/1998 | Crowder et al. | 362/253 |
| 5,908,236 | A * | 6/1999 | Lueken et al. | 362/364 |
| 6,076,595 | A * | 6/2000 | Austin et al. | 165/104.26 |
| 6,991,356 | B2 | 1/2006 | Tsimerman et al. | |
| 7,144,135 | B2 | 12/2006 | Martin et al. | |
| 7,192,155 | B2 * | 3/2007 | Morrow et al. | 362/153.1 |
| 7,300,187 | B2 | 11/2007 | Huang et al. | |
| 7,329,030 | B1 | 2/2008 | Wang | |
| 7,331,691 | B2 | 2/2008 | Livesay et al. | |
| 7,345,320 | B2 | 3/2008 | Dahm | |
| 7,497,593 | B2 * | 3/2009 | Wang | 362/249.02 |
| 7,736,032 | B2 * | 6/2010 | Chen | 362/373 |
| 7,806,550 | B2 * | 10/2010 | Tyson et al. | 362/153 |
| 7,878,691 | B2 * | 2/2011 | Liang | 362/373 |
| 2004/0156191 | A1 * | 8/2004 | Biasoli et al. | 362/153.1 |
| 2010/0314070 | A1 * | 12/2010 | Yang | 165/45 |

* cited by examiner

*Primary Examiner* — Peggy A. Neils

(57) ABSTRACT

An LED lighting fixture compatible with existing incandescent lamp lighting fixtures. The heat produced by the LED light source is dissipated through a heat pipe into a ground hole to maintain an optimum operation temperature of the LED light source.

8 Claims, 1 Drawing Sheet

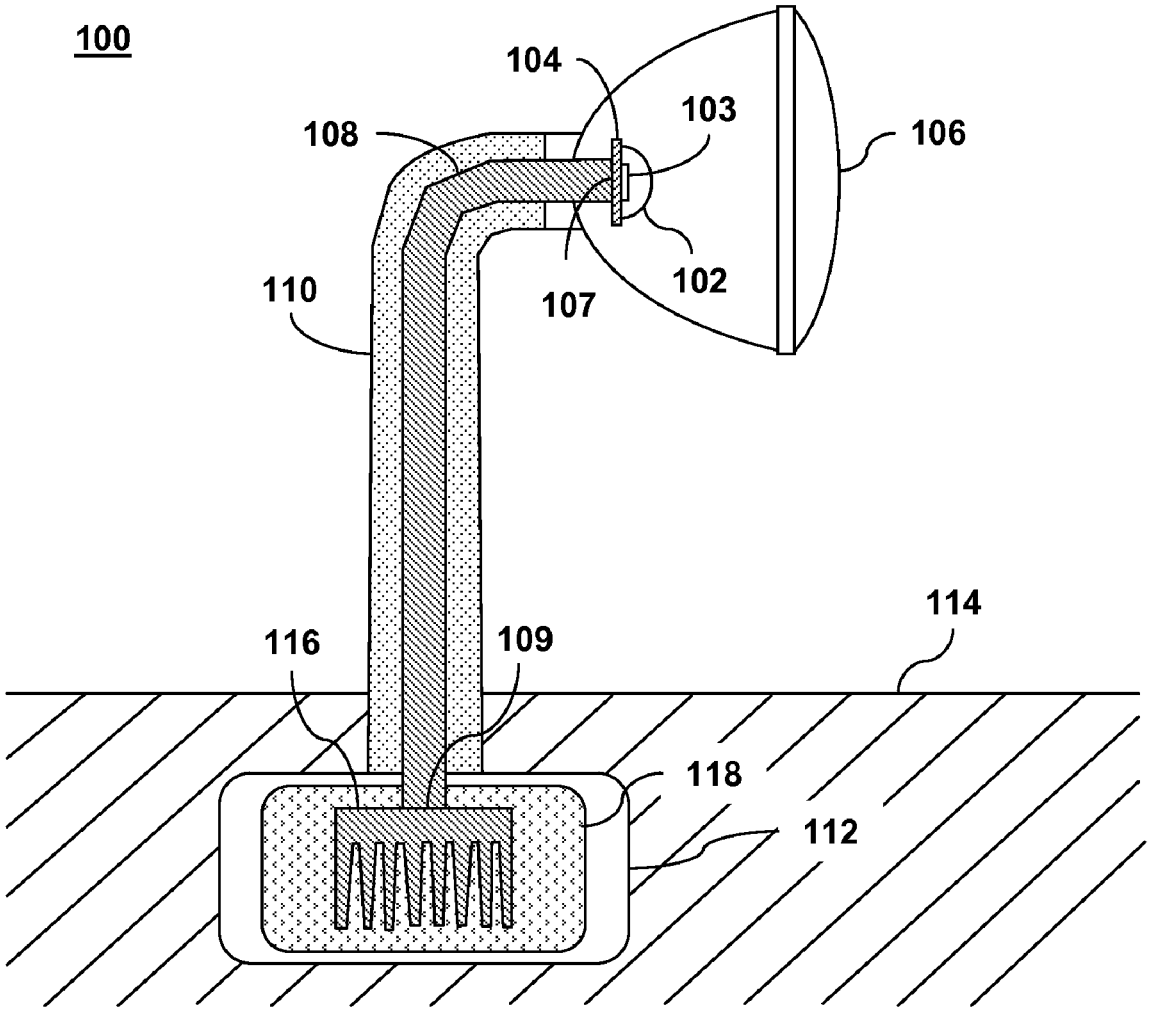
100
104
103
108
106
110
107
102
114
116
109
118
112

LED LIGHTING FIXTURE

REFERENCE TO RELATED APPLICATION

This application claims an invention which was disclosed in Provisional Patent Application No. 61/075,597, filed Jun. 25, 2008, entitled "LED LIGHTING FIXTURE". The benefit under 35 USC §119(e) of the above mentioned U.S. Provisional Applications is hereby claimed, and the aforementioned application is hereby incorporated herein by reference.

FIELD OF THE INVENTION

This invention relates to an LED lighting fixture.

BACKGROUND

Currently, there is a need/trend to retrofit/replace those incandescent lamps in many types of existing navigational lighting systems with solid state lighting devices, e.g. light emitting diodes (LEDs). Yet it is desirable to keep the existing lighting fixture (lamp holder, electrical socket, mounting pole, etc.) since this is the most economical and quickest approach in considering that the existing lighting fixture is designed to comply with many standards/testing/certifications. A new LED lighting system with a totally new enclosure design will not only increase the cost, but also delayed the deployment of LED technology.

However, the existing lighting fixture is certainly not ideal for LED light sources. The main aspect of concern is thermal loading and heat dissipation. For LED light sources, the maximum junction temperature of the LED chip should not exceed 150° C. (degree Celsius). The existing lighting fixtures could not provide efficient heat dissipation means to maintain the LED temperature below this level because they are designed for incandescent lamps whose heat is dissipated through radiation means. Although there are numerous methods disclosed in the prior art for LED thermal management, e.g. U.S. Pat. Nos. 6,991,356, 7,144,135, 7,300,187, 7,329,030, 7,331,691, and 7,345,320, none of them could provide efficient LED cooling in a limited space as defined by the existing lamp holders. This is especially true when high intensity LEDs are employed, whose power consumption is 1-2 orders higher than that of conventional LEDs.

Hence is the purpose of the present invention to effectively address these issues.

SUMMARY OF THE INVENTION

An light emitting diode (LED) lighting apparatus having an above-ground fixture positioned above the ground and an in-ground fixture positioned in or under the ground, the LED lighting apparatus comprising: at least one LED light source associated with the above-ground fixture; and at least one heat conductive element for providing heat conduction between the above-ground fixture and the in-ground fixture; wherein a temperature of the LED light source is maintained within a predetermined range through said heat conduction.

A method for producing an light emitting diode (LED) lighting apparatus having an above-ground fixture positioned above the ground and an in-ground fixture positioned in or under the ground, the method comprising the steps of: providing at least one LED light source associated with the above-ground fixture; and providing at least one heat conductive element for providing heat conduction between the above-ground fixture and the in-ground fixture; wherein a temperature of the LED light source is maintained within a predetermined range through said heat conduction.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 1 illustrates one exemplary LED lighting fixture of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to an LED lighting fixture. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 shows one exemplified embodiment of the present invention, which is a medium intensity LED edge light. Referring to FIG. 1, the LED edge light 100 utilizes an existing lighting fixture, i.e. a standard lamp holder 106 mounted on a hollow mounting pole 110, which bears electrical connections to a ground hole 112 of the existing electrical junction. An LED light source 102 is mounted within the lamp holder 106. The LED light source 102 is preferably a chip-on-board (COB) packaged high intensity LED with the LED chip 103 surface-mounted on a thermal conductive substrate 104. The COB package allows large light emitting area and high drive current for the LED chip to increase its output power. The COB package also leads to long lifespan or lifetime, as well as wavelength and intensity stability. The thermal conductive substrate 104 of the LED light source 102 is further mounted on the proximal end 107 of a heat pipe 108. The heat pipe 108 is embedded within the mounting pole 110 for conducting the heat produced by the LED light source 102 to a distal end 109, which is attached to a heat sink 116 located in the ground hole 112. The heat sink 116 is submerged inside a volume of phase change material (PCM) 118. The phase change material 118 possesses large latent heat. Thus it can absorb the heat from the heat sink 116 yet maintain a constant temperature. The PCM 118 is positioned in good thermal contact with the ground hole 112. Thus the heat stored in the PCM 118 can be dissipated into the ground 114. Through the thermal conductive substrate 104, the heat pipe 108, the heat sink 116, and the phase change material 118, the heat produced by the LED light source 102 can be quickly dissipated into the ground 114. Thus the temperature of the LED light source 102 can be maintained within an optimum operation range. The phase change temperature of the PCM 118 is selected according to the power the LED light source 102, the ground temperature inside the ground hole 112, as well as the total mass of the PCM 118.

In a slight variation of the present embodiment, the heat sink 116 is directly mounted in the ground hole 112 instead of being submerged inside a phase change material. Thus the heat from the heat sink can be directly dissipated into the ground 114.

In yet another variation of the present embodiment, an addition heat pipe (not shown) may be implemented in the mounting pole 110 to provide heat conduction between the lamp holder 106 and the ground hole 112 so that heat can be directed from the ground hole 112 to the lamp holder 106 for defrosting or defogging purposes during cold weathers. Similarly, other above-ground lighting fixtures, such as batteries, electrical circuits, optical and mechanical parts, may benefit from this heat conduction scheme to maintain their optimum operation temperature.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An light emitting diode (LED) lighting apparatus having an above-ground fixture positioned above the ground and an in-ground fixture positioned in or under the ground, the LED lighting apparatus comprising:

at least one LED light source associated with the above-ground fixture;

at least one heat sink associated with the in-ground fixture, said heat sink is submerged in a volume of phase change material; and at least one heat conductive element for providing heat conduction between the above-ground fixture and the in-ground fixture;

wherein a temperature of the LED light source is maintained within a predetermined range through said heat conduction.

2. The LED lighting apparatus of claim 1, wherein the LED light source is a high intensity chip-on-board (COB) packaged LED light source.

3. The LED lighting apparatus of claim 1, wherein the heat conductive element comprises a heat pipe.

4. The LED lighting apparatus of claim 1, wherein the phase change material is in thermal contact with the ground.

5. A method for producing an light emitting diode (LED) lighting apparatus having an above-ground fixture positioned above the ground and an in-ground fixture positioned in or under the ground, the method comprising the steps of:

providing at least one LED light source associated with the above-ground fixture;

providing at least one heat sink associated with the in-ground fixture, said heat sink is submerged in a volume of phase change material; and providing at least one heat conductive element for providing heat conduction between the above-ground fixture and the in-ground fixture;

wherein a temperature of the LED light source is maintained within a predetermined range through said heat conduction.

6. The method of claim 5, wherein the LED light source is a high intensity chip-on-board (COB) packaged LED light source.

7. The method of claim 5, wherein the heat conductive element comprises a heat pipe.

8. The method of claim 5, wherein the phase change material is in thermal contact with the ground.

* * * * *